United States Patent [19]

Yokoi

[11] Patent Number: 4,889,027

[45] Date of Patent: Dec. 26, 1989

[54] RHYTHM RECOGNIZING APPARATUS AND RESPONSIVE TOY

[75] Inventor: Gunpei Yokoi, Kyoto, Japan

[73] Assignee: Nintendo Co., Ltd., Kyoto, Japan

[21] Appl. No.: 945,386

[22] Filed: Dec. 22, 1986

[30] Foreign Application Priority Data

Dec. 26, 1985 [JP] Japan ..... 60-294981
Jan. 21, 1986 [JP] Japan ..... 61-11570

[51] Int. Cl.[4] ..... G10F 1/00; A63H 5/00

[52] U.S. Cl. ..... 84/635; 84/DIG. 12; 446/175; 446/298; 446/303

[58] Field of Search ..... 84/DIG. 12, 1.03, 94 R, 84/94 C, 95 R, 95 C, 464 R, 94.1, 94.2, 95.1, 95.2; 446/133, 139, 175, 298, 303, 354, 366, 352, 359

[56] References Cited

U.S. PATENT DOCUMENTS

| | | | |
|---|---|---|---|
| 4,314,493 | 2/1982 | Kondo | 84/DIG. 12 |
| 4,357,854 | 11/1982 | Hirano | 84/DIG. 12 X |
| 4,412,471 | 11/1983 | Stier et al. | 84/DIG. 12 X |
| 4,413,543 | 11/1983 | Iba | 84/1.28 X |
| 4,676,764 | 6/1987 | Yeu | 446/298 |
| 4,694,724 | 9/1987 | Kikumoto et al. | 84/1.03 |
| 4,820,232 | 4/1989 | Takahashi et al. | 446/298 X |

*Primary Examiner*—A. T. Grimley
*Assistant Examiner*—Matthew S. Smith
*Attorney, Agent, or Firm*—Larry A. Jackson

[57] ABSTRACT

A musical electric signal generated by electric signal generator 1 is supplied to a rhythm signal extractor 2 so that a rhythm signal is extracted. Interval data of rhythm signal peaks are stored in memory 3. Cycle detector 4 detects a musical rhythm cycle based on the interval data stored in the memory 3 and then provides a rhythm synchronizing signal in synchronization with the rhythm. The rhythm synchronizing signal is utilized as a control signal for moving portions of a toy.

21 Claims, 14 Drawing Sheets

| | D0 | D1 | D2 | D3 | D4 | D5 | D6 | D7 |
|---|---|---|---|---|---|---|---|---|
| 00 | 1 | 0 | 0 | 0 | 0 | 0 | 0 | 0 |
| 01 | 0 | 0 | 0 | 0 | 0 | 0 | 0 | 0 |
| 02 | 1 | 0 | 0 | 0 | 0 | 0 | 0 | 0 |
| ⋮ | ⋮ | ⋮ | ⋮ | ⋮ | ⋮ | ⋮ | ⋮ | ⋮ |
| 0F | 0 | 0 | 0 | 0 | 0 | 0 | 0 | 0 |
| 10 | 1 | 1 | 0 | 1 | 0 | 0 | 0 | 0 |
| 12 | 0 | 1 | 0 | 1 | 0 | 0 | 0 | 0 |
| 13 | 1 | 1 | 0 | 1 | 0 | 0 | 0 | 0 |
| ⋮ | ⋮ | ⋮ | ⋮ | ⋮ | ⋮ | ⋮ | ⋮ | ⋮ |
| 1F | 0 | 0 | 0 | 0 | 1 | 0 | 0 | 0 |
| 20 | 1 | 1 | 0 | 1 | 0 | 0 | 0 | 0 |
| 21 | 0 | 1 | 0 | 1 | 0 | 0 | 0 | 0 |
| 22 | 1 | 1 | 0 | 1 | 0 | 0 | 0 | 0 |
| ⋮ | ⋮ | ⋮ | ⋮ | ⋮ | ⋮ | ⋮ | ⋮ | ⋮ |
| 2F | 0 | 0 | 0 | 0 | 1 | 0 | 0 | 0 |
| 30 | 1 | 1 | 0 | 1 | 0 | 0 | 0 | 0 |
| 31 | 0 | 0 | 0 | 1 | 0 | 0 | 0 | 0 |
| 32 | 1 | 0 | 1 | 0 | 0 | 0 | 0 | 0 |
| ⋮ | ⋮ | ⋮ | ⋮ | ⋮ | ⋮ | ⋮ | ⋮ | ⋮ |
| 3F | 0 | 0 | 0 | 0 | 0 | 0 | 0 | 0 |

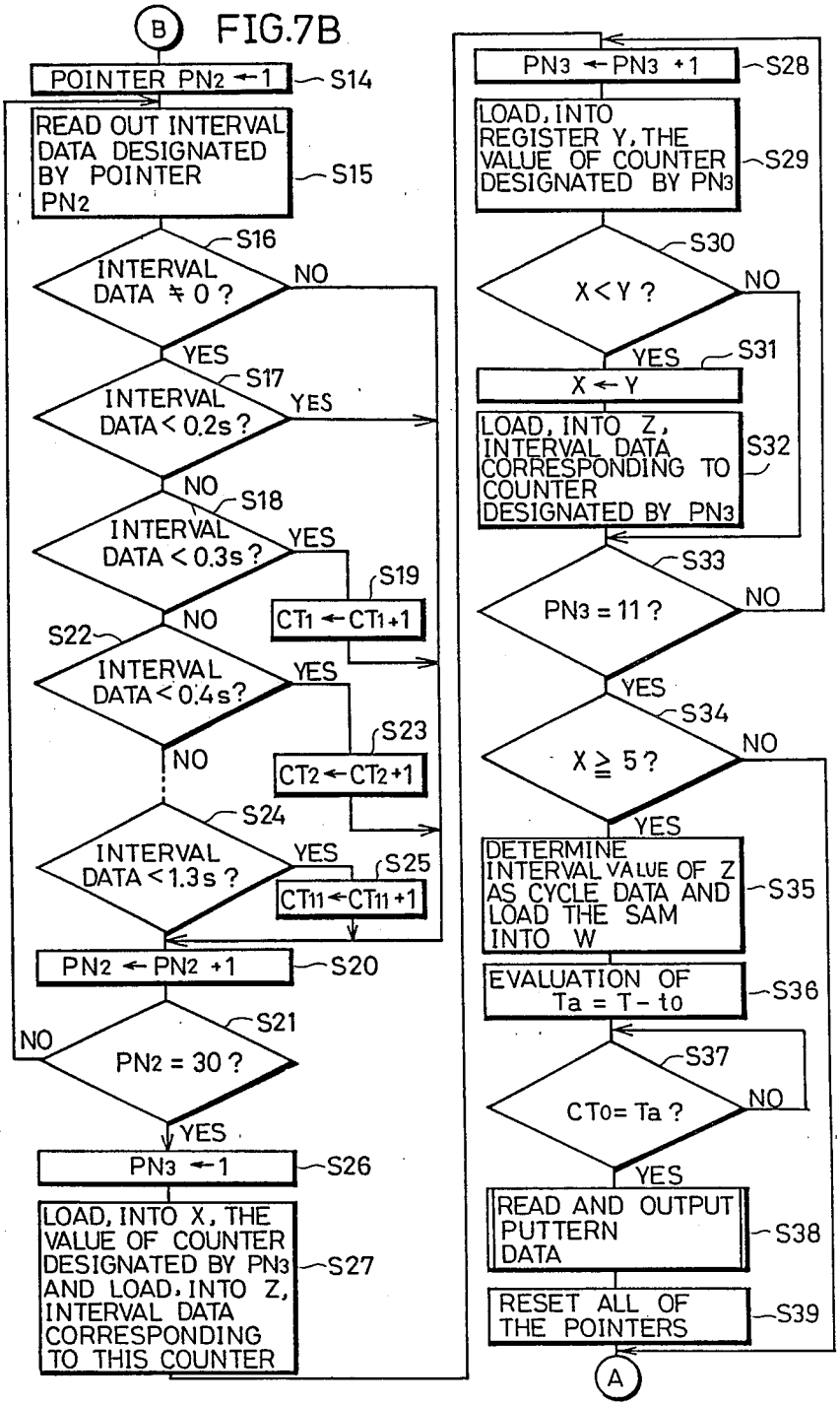
B
FIG.7B
POINTER PN2 ← 1
S14
READ OUT INTERVAL DATA DESIGNATED BY POINTER PN2
S15
S16
INTERVAL DATA ≠ 0 ?
NO
YES
S17
INTERVAL DATA < 0.2s ?
YES
NO
S18
INTERVAL DATA < 0.3s ?
YES
S19
CT1 ← CT1 + 1
NO
S22
INTERVAL DATA < 0.4s ?
YES
S23
CT2 ← CT2 + 1
NO
S24
INTERVAL DATA < 1.3s ?
YES
S25
CT11 ← CT11 + 1
PN2 ← PN2 + 1
S20
S21
NO
PN2 = 30 ?
YES
PN3 ← 1
S26
LOAD, INTO X, THE VALUE OF COUNTER DESIGNATED BY PN3 AND LOAD, INTO Z, INTERVAL DATA CORRESPONDING TO THIS COUNTER
S27
PN3 ← PN3 + 1
S28
LOAD, INTO REGISTER Y, THE VALUE OF COUNTER DESIGNATED BY PN3
S29
S30
X < Y ?
NO
YES
S31
X ← Y
LOAD, INTO Z, INTERVAL DATA CORRESPONDING TO COUNTER DESIGNATED BY PN3
S32
S33
PN3 = 11 ?
NO
YES
S34
X ≧ 5 ?
NO
YES
DETERMINE INTERVAL VALUE OF Z AS CYCLE DATA AND LOAD THE SAM INTO W
S35
EVALUATION OF Ta = T - to
S36
S37
CTo = Ta ?
NO
YES
READ AND OUTPUT PUTTERN DATA
S38
RESET ALL OF THE POINTERS
S39
A

RHYTHM RECOGNIZING APPARATUS AND RESPONSIVE TOY

BACKGROUND OF THE INVENTION

1. Field of the Invention

The present invention relates to a rhythm recognizing apparatus and toy. Particularly, the present invention relates to an apparatus for detecting rhythm of music and a toy for performing predetermined movements in response to the recognized rhythm.

2. Description of the Prior Art

A conventional apparatus for detecting musical rhythm is described in Japanese Utility Model Laid-Open No. 115296/1985 (laid-open Aug. 3, 1985). According to application, sound is detected by a pickup, such as a microphone, and the sound level is compared to a predetermined threshold value such that only a level higher than the threshold value, a peak value, is extracted. One example of a toy figure reacting to sound is one in which sound extracted by using a rhythm detecting apparatus as described above is amplified and applied to a drive mechanism of the toy.

However, a conventional rhythm detecting apparatus operates dependent on volume and cannot detect a signal dependent on a cycle, such as rhythm. Where the detected signal is applied to move a drive mechanism of the toy, a response time delay occurs between the operation of the drive mechanism and detection of a peak value. Consequently, the toy cannot move in time to the rhythm. Movement of such a toy is extremely simple and stiff, and player interest cannot be retained.

SUMMARY OF THE INVENTION

An object of the present invention is to provide a rhythm recognizing apparatus for recognizing musical rhythm and a toy performing predetermined movements in synchronization with the recognized rhythm.

In the present invention, a signal having a rhythm frequency band is extracted as a rhythm signal from a musical electric signal. Storage means stores as data the intervals at which a peak rhythm signal occurs. Then, a rhythm cycle is detected based on the interval data in the storage means so as to provide a rhythm synchronizing signal in synchronization with the detected rhythm cycle. A toy thus moves in response to the rhythm synchronizing signal.

The present invention can detect musical rhythm with extremely high precision as compared to a conventional apparatus using a threshold value discrimination system.

According to another aspect of the present invention, it is possible to produce a toy of an entirely new type that moves in precise response to musical rhythm. The movement of the toy can stimulate user interest. By changing pieces of music, the movement can be altered. Thus, the user does not lose interest in the toy. In addition, the rhythmic movement of the toy serves to develop a sense of rhythm in children while they are playing, and thus serves an educational function.

According to a further aspect of the present invention, the toy possesses numerous movable portions, and by moving these portions independently or in combination, toy movement is extremely complicated and varied. Thus, the user of the toy has fun.

These objects and other objects, features, aspects and advantages of the present invention will become more apparent from the following detailed description of the present invention when taken in conjunction with the accompanying drawings.

FIGS. 1A to 1C are block diagrams showing an essential feature of the present invention. Particularly, FIG. 1A is a block diagram showing a rhythm recognizing apparatus; FIG. 1B is a block diagram showing an example of a toy using the rhythm recognizing apparatus; and FIG. 1C is a block diagram showing another example of a toy using the rhythm recognizing apparatus.

FIGS. 7A to 7C are flow charts that explain the operation of the above stated embodiment of the present invention.

DESCRIPTION OF THE PREFERRED EMBODIMENTS

Figure 1A:
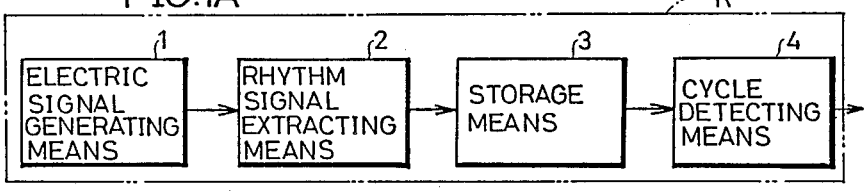
Figure 1B:
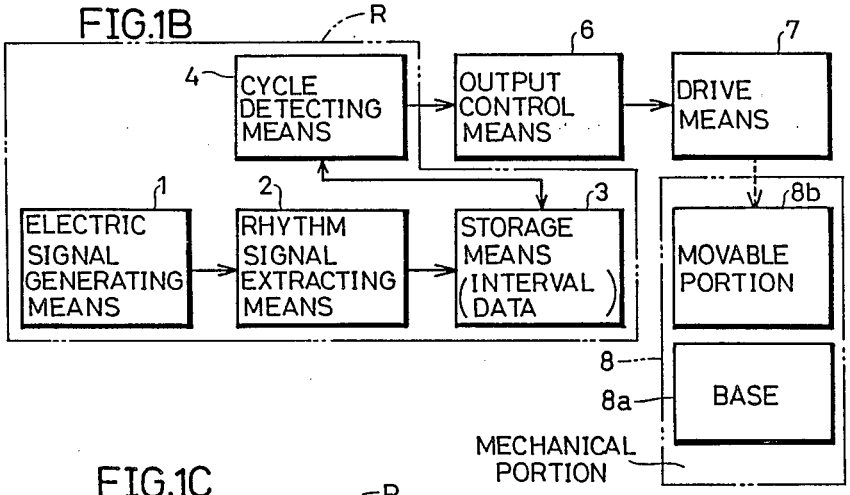
Figure 1C:
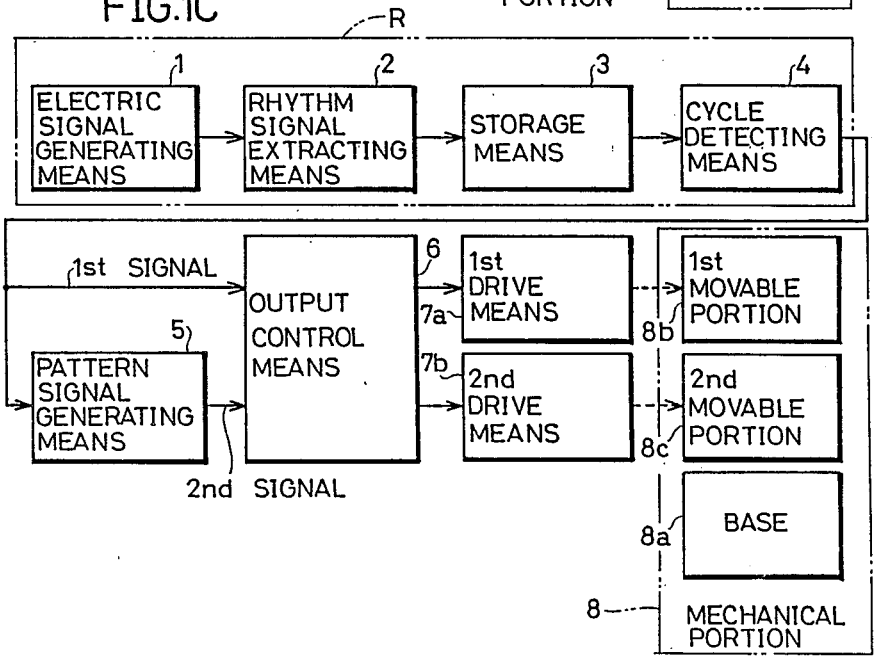

FIGS. 1A to 1C are block diagrams showing an essential feature of the present invention. Particularly, FIG. 1A is a block diagram showing a rhythm recognizing apparatus; FIG. 1B is a block diagram showing an example of a toy using the rhythm recognizing apparatus; and FIG. 1C is a block diagram showing another example of a toy using the rhythm recognizing apparatus.

Referring first to FIG. 1A, the essential feature of the rhythm recognizing apparatus R will be described. Electric signal generating means 1, which generates an electric signal corresponding to music, comprises a microphone or a music signal supplier. Rhythm signal extracting means 2 extracts, as a rhythm signal, a frequency band signal corresponding to the sound of a rhythm producing instrument. This rhythm signal is extracted by rhythm signal extracting means 2 from an electric signal provided by the electric signal generating means 1. Storage means 3 stores the interval data at which the rhythm signal extracted by the rhythm signal extracting means 2 has attained a peak. Cycle detecting means 4 detects a rhythm cycle based on the interval data stored in the storage means 3 and provides a signal in synchronization with the rhythm cycle.

Referring now to FIG. 1B, an essential feature of a toy using the rhythm recognizing apparatus R will be described. As described above with reference to FIG. 1A, the rhythm recognizing apparatus R provides a signal, in synchronization with the rhythm cycle, to output control means 6. In response to this signal, the output control means 6 energizes drive means 7. A mechanical portion 8 is a part of the drive means 7. The mechanical portion 8 comprises a base 8*a* and a movable portion 8*b*. The drive means 7 imparts movement to the movable portion 8*b* in synchronization with the rhythm. Thus, the mechanical portion 8, which has the form of a moving toy, moves in response to the rhythm of the music.

Referring to FIG. 1C, an essential feature of another toy using the rhythm recognizing apparatus R will be described. In this example, the mechanical portion 8 comprises plural (for example, two) movable portions. These movable portions move in different manners. The mechanical portion 8 comprises first and second movable portions 8*b* and 8*c*. First and second drive means 7*a* and 7*b* are provided in association the movable portions 8*b* and 8*c*, respectively. Pattern signal generating means 5 is provided in association with the cycle detecting means 4 and the output control means 6. An output from the cycle detecting means 4 of the rhythm recognizing apparatus R is supplied directly to the output control means 6, as a first signal, and is also supplied to the pattern signal generating means 5. The pattern signal generating means 5 provides, based on a certain pattern, a second signal synchronized with the signal from the cycle detecting means 4. The output control means 6 energizes either the first drive means 7*a* or the second drive means 7*b* in response to the first signal from the cycle detecting means 4, and energizes the means not energized in response to the first signal in response to the second signal from the pattern signal generating means 5. The first drive means 7*a* imparts movement to the first movable portion 8*b* when it is energized by the output control means 6. The second drive means 7*b* imparts movement to the second movable portion 8*c* when it is energized by the output control means 6. Thus, the toy can produce a greater variety of movements than be achieved in the example shown in FIG. 1B.

In the following, embodiments of the invention will be specifically described. Since the rhythm recognizing apparatus R is commonly applied to toys, a specific example related to FIG. 1C, including plural (for example, two) movable portions in the mechanical portion, will be described in FIGS. 2A to 8B.

Figure 2B:
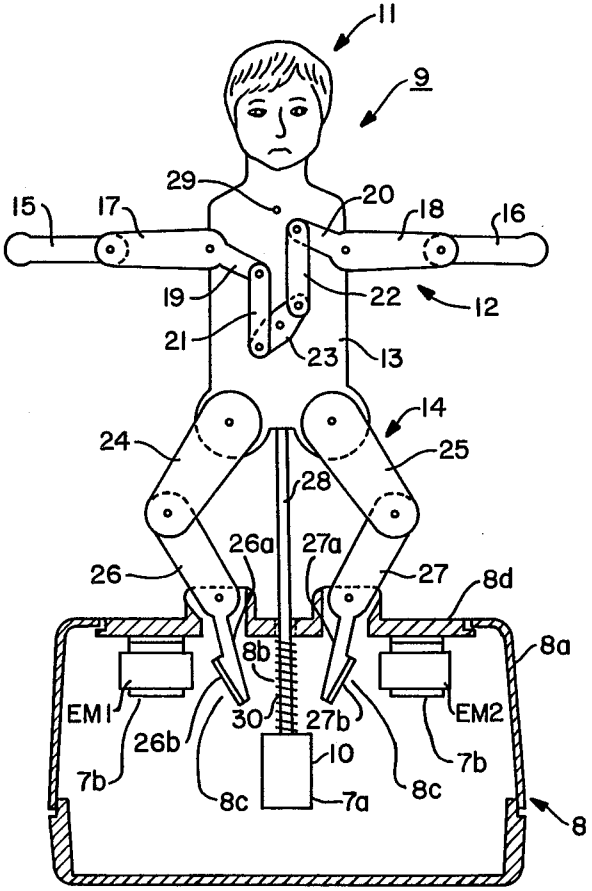
FIGS. 2A to 2C are appearance views partially in section showing an example of a mechanical portion of an embodiment of the present invention.
Figure 2A:
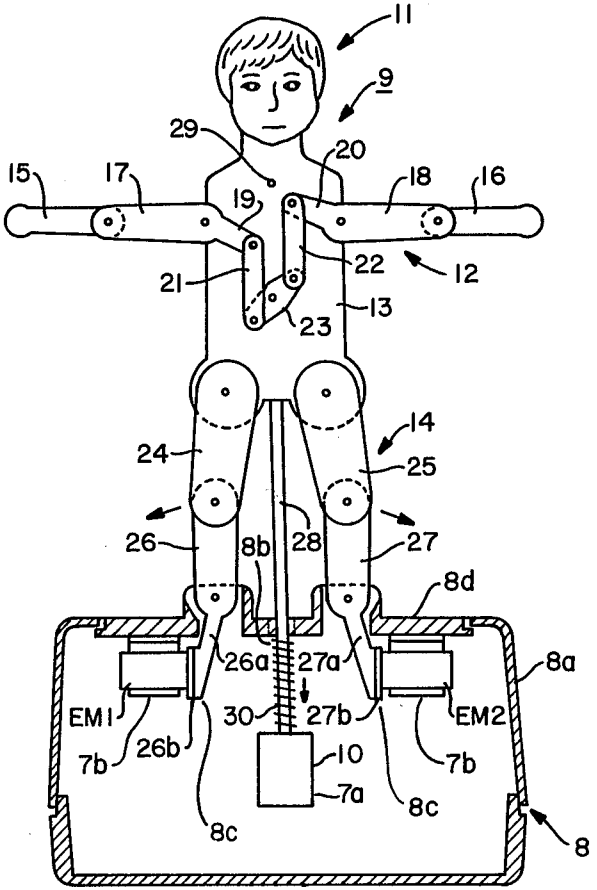
Figure 2C:
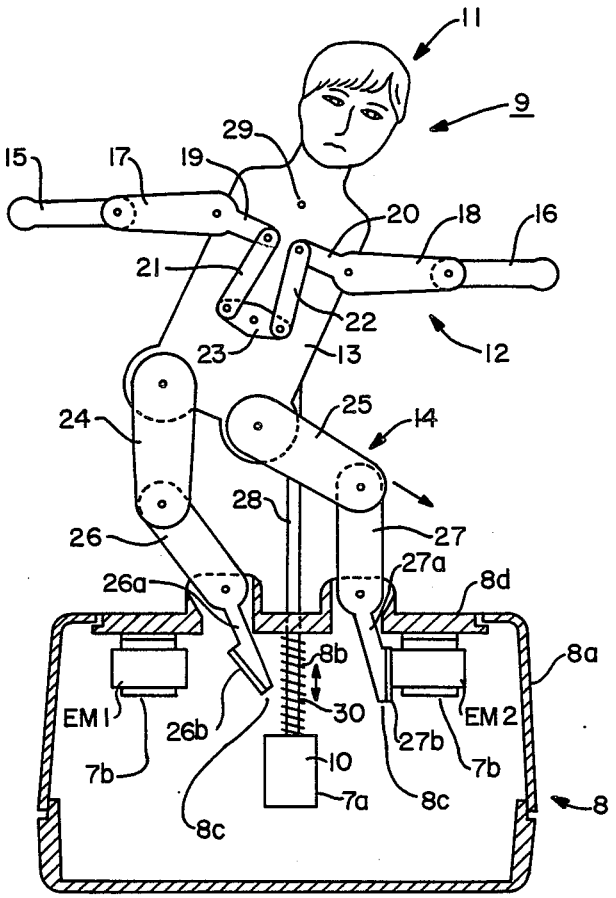

FIGS. 2A to 2C are appearance views partially in section showing an example of the mechanical portion of an embodiment of the invention. The mechanical portion of this example comprises a base 8*a*, a doll 9, a solenoid 10 as the first drive means 7*a* of FIG. 1*c*, and electromagnets EM1 and EM2 as the second drive means 7*b* of FIG. 1*c*. The solenoid 10 and the electromagnets EM1 and EM2 are contained in the base 8*a*. The doll 9 has a human shape and comprises a head 11, arms 12, a trunk 13 and legs 14. The head 11 is formed integrally at an upper end of the trunk 13. The arms 12 comprise forearm members 15 and 16 as the right and left forearms (from the elbows to the ends of the hands) and upper arm members 17 and 18 as the right and left upper arms (from the elbows to the shoulders), respectively. One end of each of the forearm members 15 and 16 is a free end. The other ends of the forearm members 15 and 16 are supported rotatably on ends of the upper arm members 17 and 18, respectively. The other ends of the upper arm members 17 and 18 are supported rotatably on the trunk 13. The ends of the upper members 17 and 18 that are supported on the trunk 13 partially extend obliquely downward and upward to form projecting portions 19 and 20, respectively. The ends of those projecting portions 19 and 20 are rotatably coupled with ends of link plates 21 and 22, respectively. The other ends of the link plates 21 and 22 are rotatably coupled with both ends of a coupling plate 23, which is rotatably supported in the central portion of the trunk 13 by a motor. In such a construction, the right and left forearms are rotatable with respect to the right and left upper arms. The right and left upper arms are rotatable with respect to the trunk 13. Since the right and left arms are coupled with each other by the link plates 21 and 22 and the coupling plate 23, they move in tandem. These arms 12 are not moved electrically but are positioned in an arbitrary manner by the user.

The legs 14 comprise thigh members 24 and 25 as the right and left thigh portions (from the knees to leg joints) and lower leg member 26 and 27 as the right and left lower leg portions (from the knees to the toes), respectively. The upper ends of the thigh members 24 and 25 are rotatably supported by lower ends of the trunk 13. The lower ends of the thigh members 24 and 25 are rotatably coupled with the upper ends of the lower leg members 26 and 27, respectively. The respective lower ends of the lower legs member 26 and 27 are supported rotatably by the base 8*a*. In addition, the lower ends of the lower leg members 26 and 27 extend downward to form projecting portions 26*a* and 27*a*, the first movable portion 8*b* of FIG. 1*c*. On the outer side surfaces those projecting portions 26*a* and 27*a*, there are iron pieces 26*b* and 27*b* opposed to the electromagnets EM1 and EM2, respectively. Thus, the right and left thigh members are rotatable with respect to the trunk 13 and the right and lower leg members are rotatable with respect to the thigh members and the base 8*a*.

An end of a shaft 28 (serving as second movable portion 8*c* of FIG. 1*c*) is coupled to a plunger of the solenoid 10 contained in the base 8*a*. The shaft 28 extends upward and passes through the upper plate of the base 8*a*, so that the other end of the shaft 28 is coupled rotatably with the trunk 13 on its back surface by means of a pin 29. A coil spring 30 is wound onto the shaft 28 between the solenoid 10 and the upper plate of the base 8*a*. The upper end of the coil spring 30 is fixed to an outer surface of the shaft 28.

Figure 4:
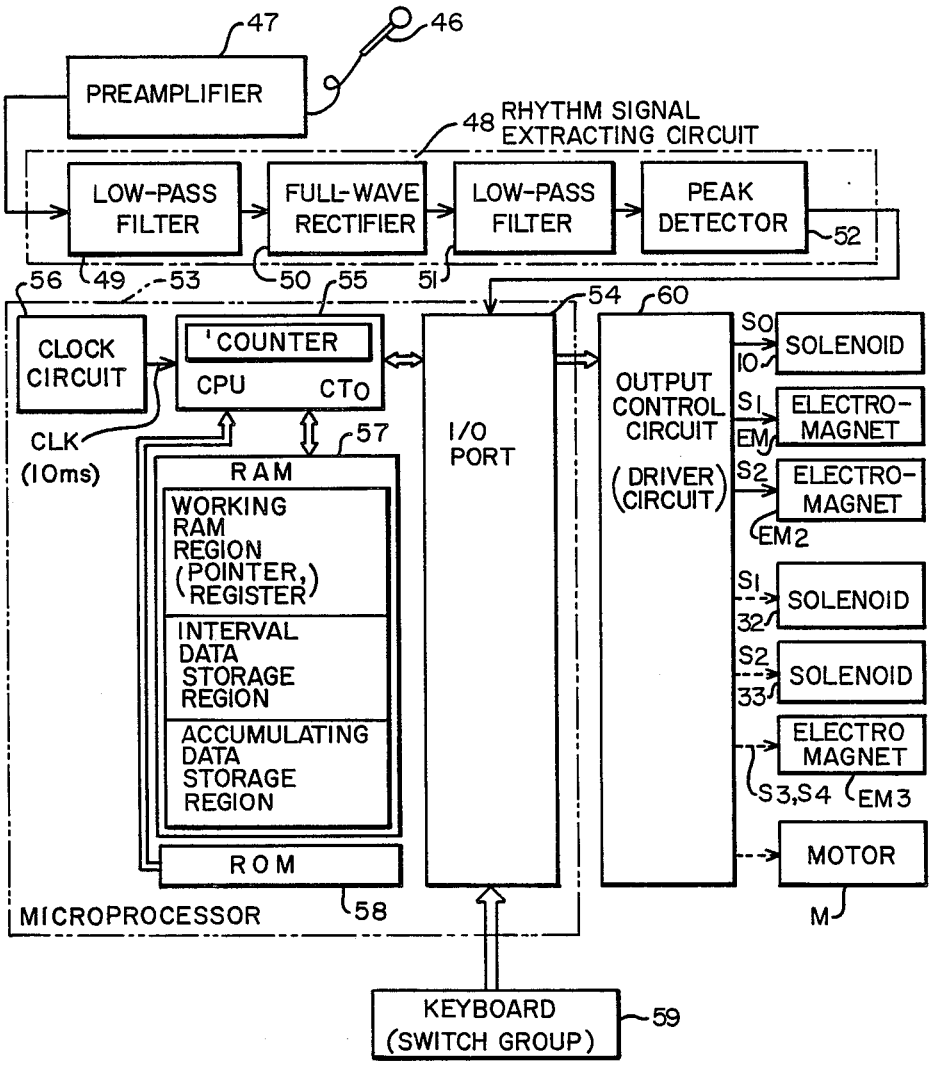
FIG. 4 is a block diagram showing an electric circuit portion of the above stated embodiment of the present invention.

A turntable 8*d* is located in the central portion of the upper face of the base 8*a* so that a rotational angle occurs with respect to the other portion of the upper face of the base 8*a* by rotation of a motor (M in FIG. 4). Due to the clockwise and counterclockwise rotation of the turntable 8*d*, the doll 9 is rotatable clockwise and counterclockwise.

In the following, fundamental operation of the embodiment shown in FIGS. 2A to 2C having the above construction will be described. FIG. 2A shows a state in which the solenoid 10 and the electromagnets EM1 and EM2 are all deenergized. In this state, the shaft 28 is pushed upward by the force of the coil spring 30. Accordingly, the shaft 2B pushes the trunk 13 upward and the doll 9 stands upright. On the other hand, FIG. 2B shows a state in which the solenoid 10 is energized and the electromagnets EM1 and EM2 are deenergized. In this state, the solenoid 10 attracts the shaft 28 against the elastic force of the coil spring 30. As a result, the trunk 13 is subjected to downward force. Accordingly, the thigh members 24 and 25 and the lower leg members 26 and 27 are rotated so as to open the legs. Thus, the trunk 13 is lowered and the height of the doll 9 becomes lower than in the upright state in FIG. 2A.

As described above, if the electromagnets EM1 and EM2 are both deenergized, the doll 9 moves vertically along a straight line by deenergizing and energizing the solenoid 10. This vertical movement is made in synchronization with musical rhythm as described later. Although the arms 12 are positioned by the user, those arms 12 move in a random manner within a range of freedom defined by oscillation caused by the vertical movement of the doll 9.

FIG. 2C shows a state in which the solenoid 10 and the electromagnet EM2 are energized and the electromagnet EM1 is deenergized. In this state, the iron piece 27*b* of the lower leg member 27 is attracted toward the electromagnet EM2. The lower leg member 27 thus does not rotate and is maintained upright even if the shaft 28 is attracted toward the energized solenoid 10. Accordingly, the doll 11 is not lowered straight along a vertical line but is lowered with the upper half of its body being inclined downward and to the right.

But, if the solenoid 10 and the electromagnet EM1 are energized and the electromagnet EM2 is deenergized, the doll 11 inclines the upper half of its body to the left while it is lowering. Thus, in combination of energization and deenergization of the solenoid 10 and the electromagnets EM1 and EM2, the doll 11 moves not only in the vertical direction but also in the rightward and leftward directions. Because, the doll 11 makes a variety of movements the user has fun. The electromagnets EM1 and EM2 are driven in association with musical rhythm.

Figure 3B:
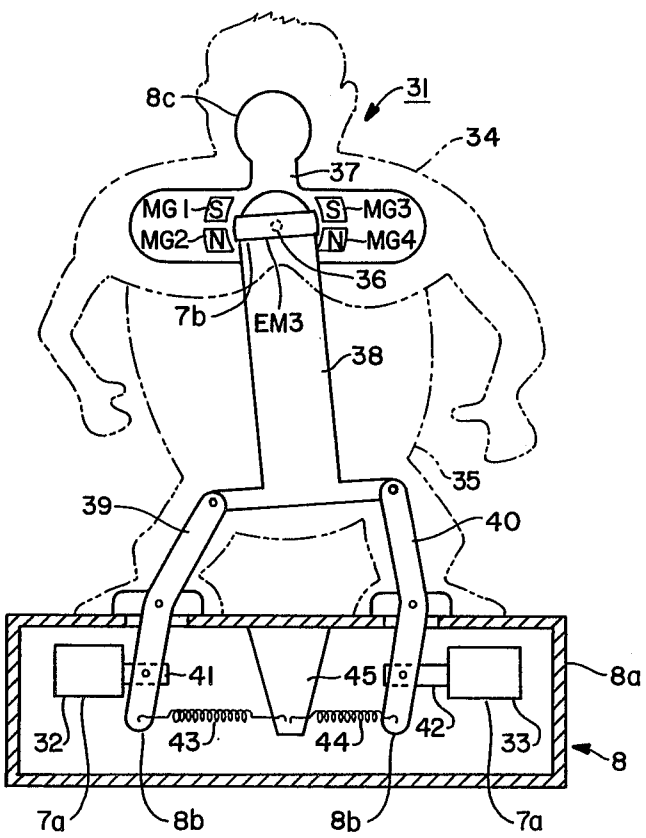
FIGS. 3A to 3C are appearance views partially in section showing another example of a mechanical portion of the embodiment of the present invention.
Figure 3A:
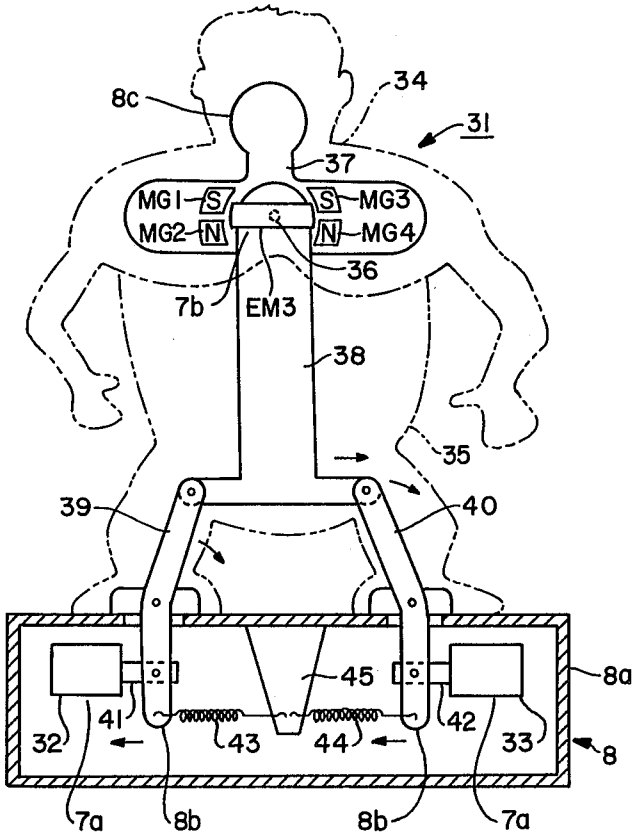
Figure 3C:
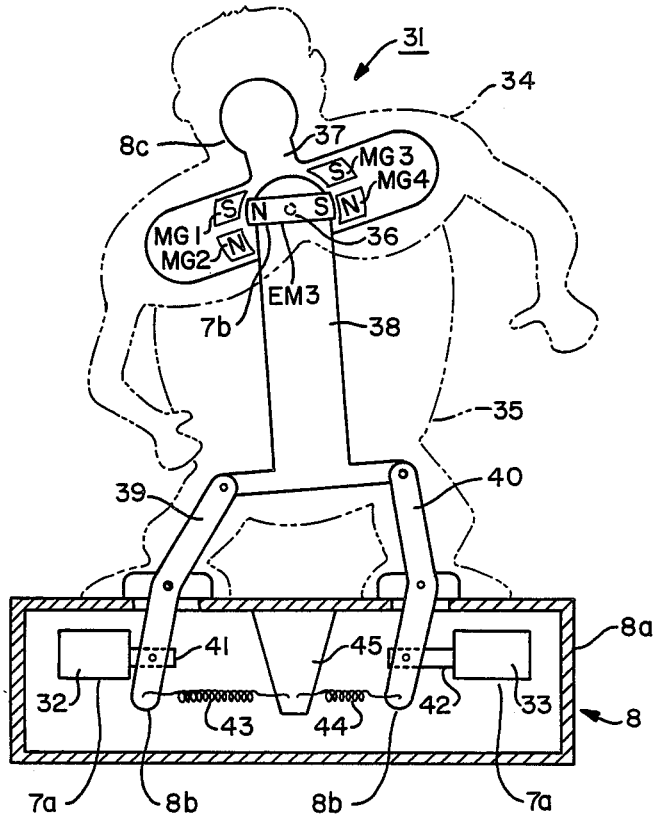

FIGS. 3A and 3C are appearance views partially in section showing a variant of the mechanical portion of the embodiment of the invention. This mechanical portion in FIGS. 3A and 3C comprises a base 8*a*, a doll 31, a pair of solenoids 32 and 33 as another example of the first drive means (7*a* of FIG. 1*c*), an electromagnet EM3 as another example of the second drive means (7*b* of FIG. 1*c*), and permanent magnets MG1 to MG4. The doll 31 of the embodiment in FIGS. 3A to 3C has a shape modeled after a gorilla. The gorilla 31 is formed by upper half 34 of the body and the lower half 35 of the body which are coupled rotatably by means of a pin 36. A skeleton member 37 (second movable portion 8*c* of FIG. 1*c*) serving as a skeleton of the upper half 34 of the body is supported rotatably by the pin 36. A skeleton member 38 serving as a skeleton of the lower half 36 of the body and an electromagnet EM3 is fixed to the skeleton member 38. Four permanent magnets MG1 to MG4 are fixed on the skeleton member 37, in the vicinity of a magnetic pole of the electromagnet EM3 and surrounding the electromagnet EM3. The permanent magnets MG1 and MG3 have an S pole and the permanent magnet MG2 and MG4 have N pole. The permanent magnets MG1 and MG2 are opposed to the permanent magnets MG4 and MG3, respectively, at an angle of 180°.

The skeleton member 38 is the shape of an inverted "T". The right end and a left end of the lower portion of the "T" are coupled to one end of a movable piece 39 and one end of a movable piece 40 (together serving as first movable portion 8*b* of FIG. 1*c*), which are rotatable. Those movable pieces 39 and 40 are located within the right and left legs, respectively, of the gorilla 31. However, those movable pieces 39 and 40 are not fixed to the lower half 35 of the body, and their movement serves to move the right and left legs of the gorilla 31. The movable pieces 39 and 40 each have the shape of an elongated plate with a slightly bent central portion. Each of the central portions, namely, the bent portions of the movable pieces 39 and 40 are supported movably by the base 8*a*. The lower ends of the movable pieces 39 and 40 extend inside the base 8*a*, passing through the upper plate of the base 8*a*. Plungers 41 and 42 of the solenoids 32 and 33, respectively, are coupled rotatably to central portions of the inserted portions of the movable pieces 39 and 40 inside the base 8*a*. In addition, ends of tension springs 43 and 44 are fixed to those lower ends of the movable pieces 39 and 40, respectively. The other ends of the tension springs 43 and 44 are fixed to a projection 45 extending downward from the inner wall of the upper plate of the base 8*a*.

In the following, the fundamental operation of the embodiment in FIGS. 3A to 3C having the above described construction will be detailed. The solenoids 32 and 33 are driven so that either both of them are deenergized or one of then is energized. Both of the solenoids 32 and 33 are never energized simultaneously, and if one of them is energized, the other is always deenergized. Energization of the electromagnet EM3 is facilitated by selectively changing the current direction. By reversing the current direction, the polarity of the ends of the electromagnet EM3 is reversed.

FIG. 3A shows a state in which solenoids 32 and 33 and the electromagnet EM3 are deenergized. In this state, no force is applied to the plungers 41 and 42 by the solenoids 32 and 33. As a result, the respective lower ends of the movable pieces 39 and 40 are pulled toward the projection 45 by the equal forces caused by the tension springs 43 and 44. Thus, the movable pieces 39 and 40 tend to rotate counterclockwise and clockwise, respectively, about the respective support points on the base 8*a*. The rotation forces are uniformly applied to both of the lower ends of the skeleton member 38. Consequently, the skeleton member 38 does not incline to either the right or left, and the gorilla 31 stands upright with its legs slightly apart.

On the other hand, FIG. 3B shows a state in which the left solenoid 32 is energized and the electromagnet EM3 is deenergized. In this state, the plunger 41 is drawn into the energized solenoid 32. As a result, the movable piece 39 rotates clockwise against the force of the tension spring 43. The rotation force of the movable piece 39 is transmitted to the movable piece 40 through the lower portion of the skeleton member 38, whereby the balance of the forces of the movable pieces 39 and 40 is overcome. As a result, the movable pieces 39 and 40 both rotate clockwise. Thus, the skeleton member 38 inclines left. The lower half 35 of the body of the gorilla 31 thus inclines left. The upper half 34 of the body is in the same state as shown in FIG. 3A, although it swings according to the movement of the lower half 35 of the body because the upper half 34 is supported rotatably on the lower half 35 by means of the pin 36 and the electromagnet EM3 is deenergized. Thus, the gorilla 31 assumes a posture in which only its haunches move to the right with its shoulders being maintained horizontal.

But, if only the left solenoid 33 is energized, only the gorilla's haunches move to the left while its shoulders are maintained horizontal, contrary to FIG. 3B.

FIG. 3C shows a state in which the solenoid 32 and the electromagnet EM3 are energized and the solenoid 33 is deenergized. In this case, the gorilla 31 moves its haunches to the right in the same manner as in FIG. 3B. In FIG. 3C, the N pole is the left end of the electromagnet EM3 and the S pole is the right end. The N pole and the permanent magnet MG1 attract each other and the S pole and the permanent magnet MG4 attract each other. As a result, the upper half 34 of the body of the gorilla 31 inclines to the left. More specifically, the gorilla 31 assumes a posture in which its haunches are moved to the right and its left shoulder is lowered. If the current direction of the electromagnet EM3 is reversed the polarity is also reversed and the permanent magnets MG2 and MG3 are attracted by the electromagnet EM3, to FIG. 3C, the gorilla 31 lowers its right shoulder.

The above described postures of the gorilla 31 can be selected according to rhythm of the music.

In the example shown in FIGS. 3A to 3C, movement of the gorilla's haunches and shoulders are made in tandem. The gorilla 31 thus performs a variety of movements, which enhances enjoyment in the same manner as in the example shown in FIGS. 2A to 2C.

Although the dolls in the two above described examples are shaped like a human and an animal, the doll may be shaped like a robot, an imaginary animal or a cartoon character. In addition, the present invention is not limited to a doll, other forms such as a vehicle or a plant may also be adopted. In sum, the moving toy may adopt various forms.

FIG. 4 is a block diagram showing an electric circuit portion of the above stated embodiment of the present invention. Referring to FIG. 4, a microphone 46, an example of electric signal generating means, is connected to a preamplifier 47. An output of the preamplifier 47 is supplied to a rhythm signal extracting circuit 48, an example of the rhythm signal extracting means 2. The rhythm signal extracting circuit 48 comprises a low-pass filter 49 having a cut-off frequency of 100 to 250 Hz, a full-wave (or half-wave) rectifier 50, a low-pass filter 51 having a cutoff frequency of 10 to 30 Hz, and a peak detector 52. An output of the peak detector 52 is supplied to a CPU 55 through an I/O port 54 included in a microprocessor 53. The microprocessor 53 performs the functions of the cycle detecting means 4 and the pattern signal generating means 5 shown in FIG. 1C. The CPU 55 comprises an arithmetic operation portion and a counter CTO. The counter CTO receives and counts reference clocks CLK of a predetermined cycle (for example 0.01 sec.=10 ms) from a clock circuit 56. A count value of the counter CTO is used as interval data for a rhythm signal extracted by the rhythm signal extracting circuit 48. The CPU 55 is connected to a RAM 57 and a ROM 58. The microprocessor 53 is formed by the I/O port 54, the CPU 55, the clock circuit 56, the RAM 57 and the ROM 58. The I/O port 54 is connected to a keyboard 59 and an output control circuit 60, an example of the output control means 6. The keyboard 59 comprises a plurality of switches such as a start/stop switch and a pattern selection switch, and is located on the base 8*a*. The user operates the keyboard 59 so that instructions are issued to start and stop the apparatus of the embodiment and to select a movement pattern of the doll from amongst predetermined movement patterns. The output control circuit 60 comprises a driver circuit so as to control operation of the above stated solenoids 10, 32 and 33 and the electromagnets EM1, EM2 and EM3. If the mechanical portion of the example shown in FIGS. 2A to 2C is adopted, the solenoid 10 and the electromagnets EM1 and EM2 are used. If the mechanical portion of the example shown in FIGS. 3A to 3C is adopted, the solenoids 32 and 33 and the electromagnet EM3 are used.

Figure 5:
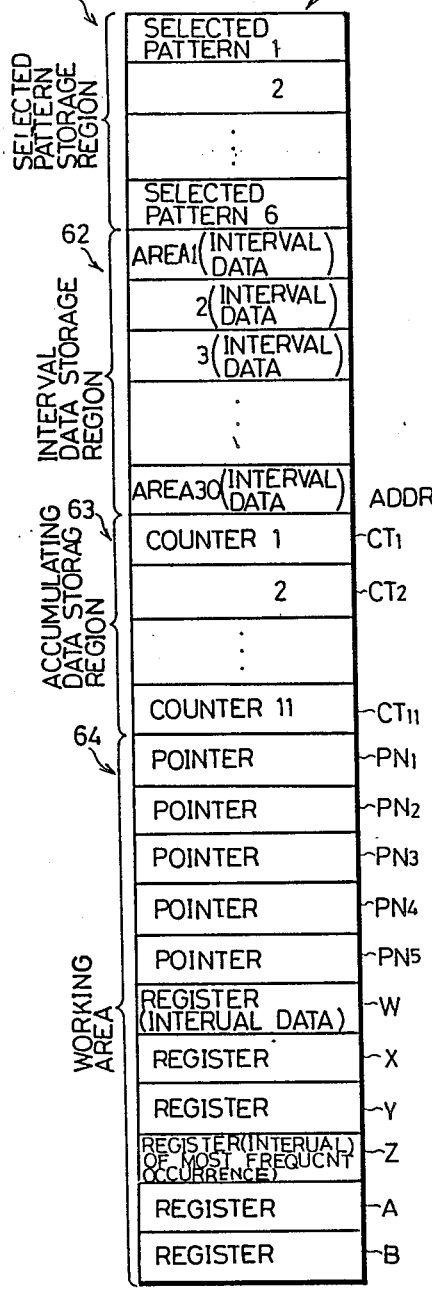
FIG. 5 is an illustration showing storage regions of the RAM 57 shown in FIG. 4.

FIG. 5 is an illustration showing storage regions of the RAM 57 shown in FIG. 4. Referring to FIG. 5, the RAM 57, an example of the storage means 3, comprises a selected pattern storage region 61, an interval data storage region 62, and accumulating data storage region 63 and a working area 64. The selected pattern storage region 61 stores movement patterns of the doll 9 or 31, preset by means of the keyboard 59 shown in FIG. 4, according to the presetting order. For example, six kinds of movement patterns in total may be utilized. Detailed data of the movement patterns are stored in an output pattern storage region 66 (see FIG. 6) of the ROM 58. First addresses of the areas of the output pattern storage region 66 corresponding to the preset movement patterns are stored in the selected pattern storage region 61.

The interval data storage region 62 stores interval data (the count value of the counter CTO) of peaks of musical rhythm (which are extracted by the rhythm signal extracting circuit 48) received by the microphone 46. The interval data storage region 62 includes a predetermined number of areas (30, for example) for storing pieces of interval data (30, for example). Interval data is written in the interval data storage region 62 by circulating the interval data in write addresses of the region 62. If all the areas of the interval data storage region 62 are occupied, the newest interval data is rewritten in the area where the oldest interval data has been written.

The accumulating data storage region 63 utilizes one byte as a counter and includes 11 counters CT1 to CT11. The accumulating data storage region 63 classifies, into predetermined regions of time, interval data existing within a fixed range of time out of the interval data stored in the interval data storage region 62, and totals the interval data in each of the regions of time. In this embodiment, interval data within a range of time from 0.2 sec. to 1.3 sec. is counted for each region in intervals of 0.1 sec. (100 ms). For example, the counter CT1 counts the number of occurrences of interval data in a region from 0.2 sec. to 0.3 sec. The counter CT2 counts the number of occurrences of interval data in a region from 0.3 sec. to 0.4 sec. The other counters count in the same manner. The reason for selecting the range from 0.2 sec. to 1.3 sec. for the counting of interval data is that this range can sufficiently cover any tempo since the length of one beat in the slowest tempo (for example, largo) is approximately one second and the length of one beat in the fastest tempo (for example, allegro presto) is approximately 0.33 sec.

The working area comprises pointers and registers. A pointer PN1 serves to designate a write address in the interval data storage region 62. A pointer PN2 serves to designate a read address in the interval data storage region 62. A pointer PN3 serves to designate one of the counters CT1 to CT11 (namely, a read address in the accumulating data storage region 63). A pointer PN4 serves to designate a read address in the selected pattern storage region 61. A pointer PN5 serves to designate a read address in the output pattern storage region 66 of the ROM 58 to be described afterwards. A register W stores detected music cycle data (obtained by arithmetic operation). Registers X and Y serve to detect the largest number of occurrences out of the interval data counted for the regions in 0.1 sec. increments and stored in the counters of the accumulating data storage region 63. More specifically, the register X stores the largest number of occurrences out of the values obtained during detecting operation. The register Y stores the count value of each counter, namely, the number of occurrences of interval data read out successively from the accumulating data storage region 63. Then, the number of occurrences stored in the register X and the number of occurrences stored in the register Y are compared and if the number of occurrences stored in the register Y is larger than that in the register X, the content stored in the register Z stores the interval data value corresponding to the counter which stores the largest number of occurrences. A register A stores data read out from the selected pattern storage region 61 by address designation of the pointer PN4 (the first address of an pattern data stored in the output pattern storage region of the ROM 58). A register B stores a read address of the output pattern storage region 66 of the ROM 58.

Figure 6:
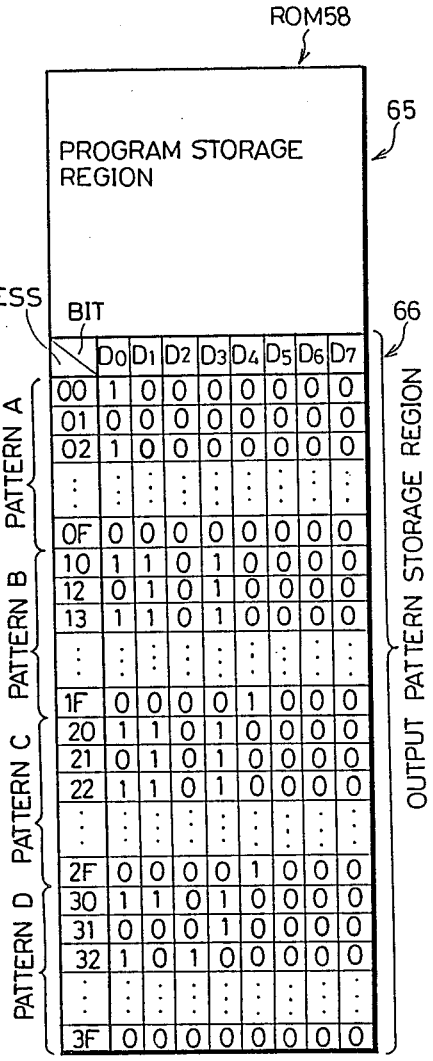
FIG. 6 is an illustration showing storage regions of the ROM 58 shown in FIG. 4.
Figure 7A:
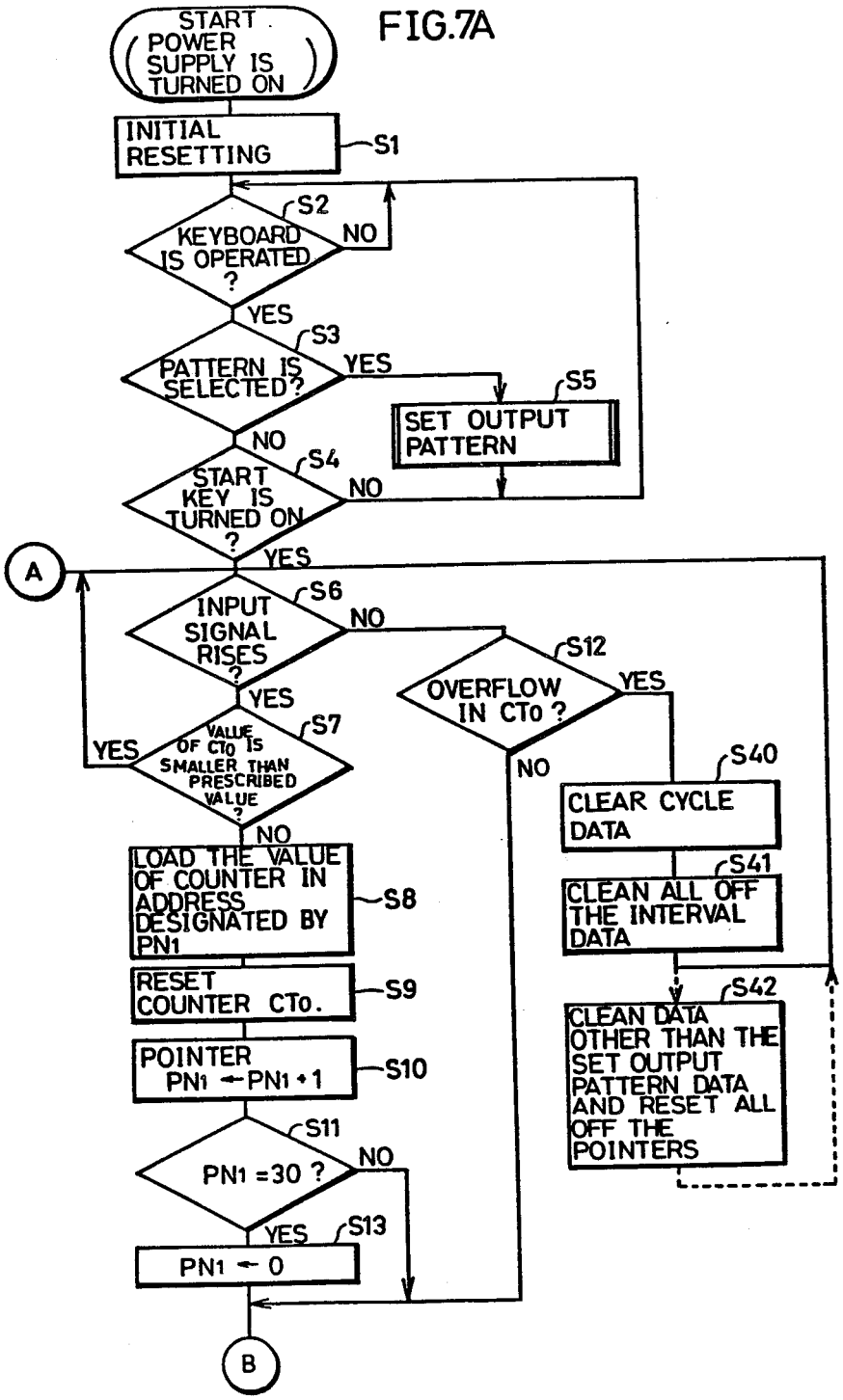
Figure 7C:
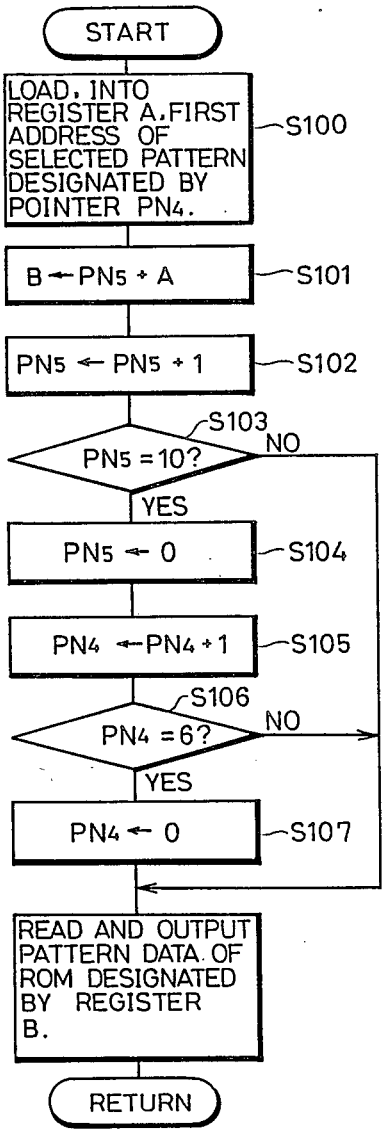

FIG. 6 is an illustration showing storage regions of the ROM 58 shown in FIG. 4. Referring to FIG. 6, the ROM 58 comprises a program storage region 65 and an output pattern storage region 66. An operation program (as shown in FIGS. 7A to 7C) of the CPU 55 (shown in FIG. 4) is stored in the program storage region 65. The output pattern storage 66 stores many types of data (for example, four kinds of data from the pattern A to the pattern D) concerning the movement patterns of the doll 9 or 31. Each movement pattern (output pattern) is composed of 16 bytes of 00 . . . 0F (which are hexadecimal numbers, the mark * is hereinafter attached to a hexadecimal number). One byte is composed of eight bits of D0 to D7. In the example shown in FIGS. 2A and 2B, bits D0 to D3 are used. The solenoid 10 is deenergized or energized by the logic "0" or "1" of the bit D0. The electromagnet EM1 or EM2 is energized by the logic "1" of the bit D1 or D2. The motor M for rotating the table 8*d* is rotated dependent on the logic state of the bit D3.

In the example shown in FIGS. 3A and 3B, bits D1 and D2 are used. More specifically, the solenoid 32 is energized by the logic "1" of the bit D1 and the solenoid 33 is energized by the logic "1" of the bit D2. The four kinds of pattern data stored in the output pattern storage region 66 can be preset by operation of the keyboard 59 (shown in FIG. 4) by the user. The first address of each preset pattern is loaded in the selected pattern storage region 61 (as shown in FIG. 5).

Figure 8A:
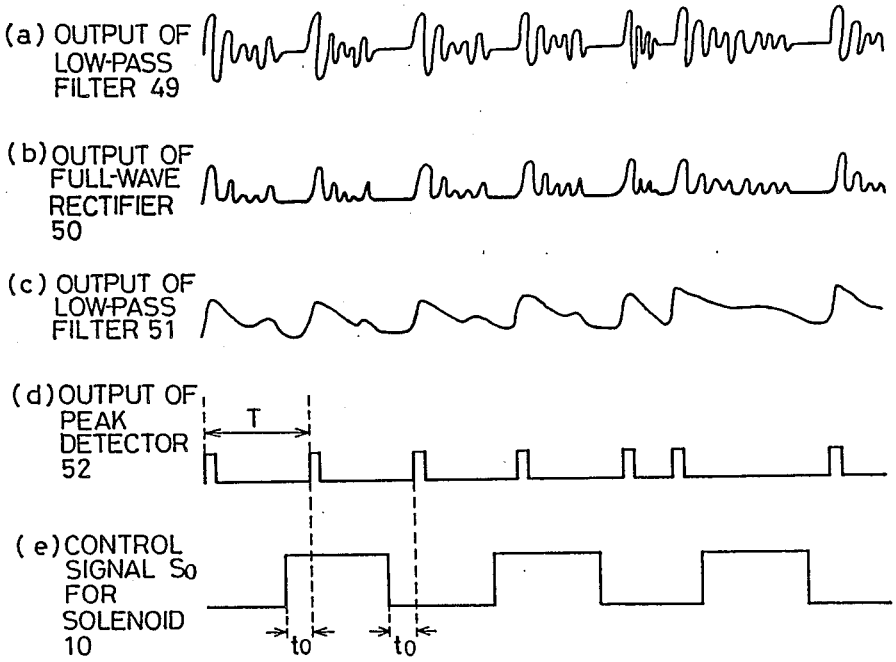
FIGS. 8A and 8B are timing charts that explain the operation of the above stated embodiment of the present invention.

FIGS. 7A to 7C are flow charts for explaining operation of the above stated embodiment shown in FIGS. 2A and 2B or FIGS. 3A and 3B. FIG. 7C shows details of a subroutine of the step S38 shown in FIG. 7B. FIGS. 8A and 8C are timing charts for explaining the operation of this embodiment. Referring to these figures, the operation of the above stated embodiment will be described in the following paragraphs.

Referring first to FIG. 8A, operation of the rhythm signal extracting circuit 48 shown in FIG. 4 will be described. When music starts, the microphone 46 converts the sound into an electrical signal. The sound signal (music signal) converted to the electrical signal is amplified by the preamplifier 47 and supplied to the rhythm signal extracting circuit 48. In the rhythm signal extracting circuit 48, the low-pass filter 49 removes a high-frequency component of the sound signal supplied from the preamplifier 47 so as to extract the signal of a low tone rhythm musical instrument. A low-frequency converted signal as shown in (a) of FIG. 8A is thus provided. The full-wave (or half-wave) rectifier 50 removes the full-wave (or the half-wave) from the low-frequency converted signal (the case of the half-wave is shown in (b) of FIG. 8A) so that the full-wave (or the half-wave) is supplied to the low-pass filter 51. The low-pass filter 51 detects the output envelope of the full-wave rectifier 50 to remove noise or an unnecessary low level peak value such that a signal as shown in (c) of FIG. 8A is provided. The peak detector 52 discriminates the output of the low-pass filter 51 from a prescribed threshold value so that a signal representing a peak (as shown in (d) of FIG. 8A) is provided. This peak signal represents a peak of the musical rhythm. Based on the output of the rhythm signal extracting circuit 48, a cycle of the musical rhythm can be detected. This detection can be attained by an arithmetic operation in the microprocessor 53.

More specifically, the microprocessor 53 accumulates interval data of rhythm peaks by allotting each piece of the interval data to one of the regions of time divided into 0.1 sec. intervals, and determines the rhythm cycle in which the interval data occurs most frequently. During this period, each interval of the rhythm peaks is measured by the counter CTO. More specifically, the counter CTO always counts reference clocks CLK (with a cycle of 10 ms) from the clock circuit 56, independently of the operation of the CPU 55 (shown in FIGS. 7A to 7C). Each time a rhythm peak is detected, the count value of the counter CTO at that time is written as interval data of the peak in one of the areas of the interval data storage region 62 of the RAM 57. Approximately at the same time, the counter CTO is reset and measures the subsequent interval data. Thus, the count value of the counter CTO represents a time interval of the rhythm peaks. If the reference cycle clocks CLK of the clock circuit 56 is decreased, the evaluation resolution of the rhythm cycle in the microprocessor 53 can be enhanced.

Next, operation of the above described embodiment will be described based on the operation of the CPU 55.

First of all, when the power supply (not shown) is activated, the operation shown in FIG. 7A is started. In steps S1 to S5, a movement pattern is set by keyboard input. More specifically, in step S1, initial resetting is performed and all the data in the RAM is cleared. Then, in step S2, it is determined whether the keyboard 59 is being used to input data. If the keyboard 59 is not being operated, the step S2 is repeated so that the apparatus is in a standby state. If the keyboard 59 is being operated, the program proceeds to the step S3 to determine whether movement patterns have been selected. If movement patterns have been selected, the program proceeds to the step S5 in which the first address of the corresponding pattern area of the output pattern storage region 66 is written in each area of the selected pattern storage region 61 according to the setting order of the movement patterns. Then, the program returns to step S2. If a start key (not shown) is activated after the selection of the movement patterns, the activation of the star key is determined in the step S4 and the program proceeds to the subsequent steps.

In steps S6 to S13, the interval data measured by the counter CTO is stored in the interval data storage region 62. More specifically, in step S6, it is determined whether the rhythm signal from the rhythm signal extracting circuit 48 is rising. If the rhythm signal is rising, the program proceeds to step S7 in which it is ascertained if the count value of the counter CTO is smaller than a prescribed value (for example, a value corresponding to 0.1 sec.). If the count value is smaller than the prescribed value, noise is present or an erroneous detection has been made. In order to avoid this noise or erroneous detection, the count value is not loaded and the program returns to step S6. Depending on the music, as shown in (d) of FIG. 8A, the rhythm interval may become extremely short in an intermediate portion of the music, such as between the fifth and six pulses form the left in the figure. In this case, the interval data between the fifth and sixth pulses is not taken into account. This does not cause any problem because the rhythm cycle as a whole is obtained by evaluation based on the pieces of interval data. On the other hand, if it is determined in step S7 that the count value of the counter CTO is larger than the prescribed value, the program proceeds to step S8 and the count value of the counter CTO is loaded in an address of the interval data storage region 62 designated by the pointer PN1 (0 at first). The interval data is first loaded in area 1 of the interval data storage region 62. Then, the program proceeds to step S9 and the counter CTO is reset. As a result, the counter CTO again starts to measure a time interval from the present input pulse to the subsequent input pulse. Subsequently, the program proceeds to step S10, in which the value of the pointer PN1 is incremented to advance the read address of the interval data storage region 62. Then, in step S11, it is ascertained if the value of the pointer PN1 is 30. If the value is less than 30, the program proceeds directly to the operation steps shown in FIG. 7B. If the value is 30, which means that the pointer PN1 designates an area succeeding the final area of the interval data storage region 62, then the pointer PN1 is set to 0 and address designation is reinitiated, staring with the first area of the interval data storage region 62. As a result, the read address circulates (from 0 to 29) in the interval data storage region 62 and the newest interval data is written in the area in which the oldest interval data had been written. Consequently, the data in the interval data storage region 62 is successively erased, starting with the oldest interval data. If it is determined in step S6 that the rhythm signal is not rising, the program proceeds to step S12 where it is ascertained if overflow (of more than two seconds) has occurred, the program proceeds to the steps in FIG. 7B.

Means for determining to which time region each piece of data belongs is by way of CPU 55 and includes steps S14 to S25. In steps S14 to S25 shown in FIG. 7B, classification and accumulation of interval data are performed. First, in step S14, 1 is set in the pointer PN2. In step S15, the interval data of the address designated by the pointer PN2 is read out from the interval data storage region 62. Then, in step S16, it is ascertained if the read-out interval data is 0. If the interval data is not 0, it is ascertained in step S17 if the interval data is smaller than 0.2 sec. If the interval data is 0, or smaller than 0.2 sec., noise or erroneous detection is assumed to have occurred and the program skips the subsequent steps and advances directly to step S20. On the other hand, if the interval data is equal to or larger than 0.2 sec., the program proceeds to step S18 and it is ascertained if the interval data is smaller than 0.3 sec. If the interval data is smaller than 0.3 sec., (equal to or larger than 0.2 sec. and smaller than 0.3 sec.), the counter CT1 in the accumulating data storage region 63 is incremented by 1. Then, the program proceeds to step S20, where the value of the pointer PN2 is incremented by 1 to advance the read address of the interval data storage region 62. Then, the program proceeds to step S21 where it is ascertained if the value of the pointer PN2 is 30. If the interval data in the final area of the interval data storage region 62 is not read out, the value of the pointer PN2 is smaller than 30 and, as a result, the program returns to step S15 and the interval data in the next area is read out and accumulated. On the other hand, if it is determined in the step S18 that the interval data is not smaller than 0.3 sec., the program proceeds to step S22 where it is ascertained if the interval data is smaller than 0.4 sec. (equal to or larger than 0.3 sec. and smaller than 0.4 sec.). If the interval data is smaller than 0.4 sec., the program proceeds to step S23 where the counter CT2 is incremented by 1. The program next proceeds to step S20. Subsequently, it is determined in the same manner the region in which the read-out interval data belongs, and the count value of the counter is incremented. Finally, in step S24, it is ascertained if the interval data is smaller than 1.3 sec. (equal to or larger than 1.2 sec. and smaller than 1.3 sec.). If the interval data is smaller than 1.3 sec., the count value of the counter CT11 is incremented in step S25 and the program proceeds to steps S20. On the other hand, if the interval data is not smaller than 1.3 sec., none of the counters are incremented and the program proceeds to step S20. Therefore, in this embodiment, the interval data read out from the interval data storage region 62 is classified and accumulated according to which time region (from 0.2 sec. to 1.3 sec. in 0.1 sec. intervals) each read-out interval data belongs. The interval data to be selected are thus accumulated in the range from 0.2 sec. to 1.3 sec. As a result of the above stated steps S14 to S25, the number of occurrences of the interval data belonging to each time region are stored in the respective counters CT1 to CT11.

Then, in steps S26 to S33, the interval data with the largest number of occurrences is detected. First, in step S26, 1 is set in the pointer PN3. Then, in step S27, the value of the counter in the accumulating data storage region 63 designated by the pointer PN3 is loaded in the register X, and the interval value related to that counter (the interval value being assigned in advance for each of the counters CT1 to CT11) is loaded in the register Z. Subsequently, in step S28, the value of the pointer PN3 is incremented by 1 to advance the read address of the accumulating data storage region 63. Then, the program proceeds to step S29 where the count value of the counter designated by the pointer PN3 is loaded in the register Y. In step S30, the value of the register X and value of the register Y are compared. If the value of the register X is larger than the value of the register Y, the program skips the steps S31 and S32 and advances directly to step S33. If the value of the register Y is larger than the value of the register X, the program proceeds to step S31 and the value of the register Y is transferred to the register X. Thus, the count value concerning the largest number of occurrences is always stored in the register X. Then, the program proceeds to step S32 where the interval value corresponding to the counter designated by the pointer PN3 is loaded in the register Z. Thus, the interval value of the largest number of occurrences is stored in the register Z. Subsequently, in step S33, it is ascertained if the value of the pointer PN3 is 11, and thus whether processing by the final counter CT11 in the accumulating data storage region 63 is completed. If the value of the pointer PN3 is smaller than 11, processing by the counter CT11 is not completed and, consequently, the program returns to step S28 where the above described operations are repeated.

On the other hand, if the value of the pointer PN3 is 11, the program proceeds to step S34 where it is ascertained if the value of the register X is equal to or larger than 5. If the value of the register X is smaller than 5, sufficient interval data has not been accumulated to determine rhythm cycle data. Then, the program returns to step S6, shown in FIG. 7A, to restart detection and accumulation of interval data. On the other hand, if the value of the register X is equal to or larger than 5, the program proceeds to step S35 where the interval value stored in the register Z is determined to be rhythm cycle data T. This data is then loaded in the register W.

Timing means for transmitting the rhythm synchronizing signal prior to the start of each rhythm cycle is by way of CPU 55 and includes steps S36 and S37. In steps S36 to S39, output control for driving the doll is illustrated. First, in step S36, the drive control starting time is evaluated (Ta=T−t0. In this evaluation, t0 represents the response delay time of the drive mechanism of this embodiment. The control starting time is set by taking into account the response delay time of the drive mechanism so that a time lag does not occur between the movement of the doll 9 or 31 and the rhythm of the music. In step S37, it is ascertained if the count value of the counter CTO attains the time Ta. The counter CTO had previously started again in step S9, and since the operations in steps S9 to S36 are performed at high speed by the CPU 55, the count value of the counter CTO never attains time Ta before the program proceeds to step S37. When the count value of the counter CTO attains time Ta, the program proceeds to step S38 to read pattern data from the output pattern storage region 66 according to a predetermined order and to control its output. Details of the subroutine of step S38 are shown in FIG. 7C. The operation of this subroutine will be described in the following paragraphs.

First, in step S100, a first address of the preset movement pattern (a first address of any of the pattern data areas of the output pattern storage region 66) is read from the address of the selected pattern storage region 61 designated by the pointer PN4 (0 at first) and the read-out address is loaded in the register A. Subsequently, in step S101, the value of the pointer PN5 (0 at first) is added to the register A and the result of the addition is loaded in the register B. Then, in step S102, the value of the pointer PN5 is incremented by 1 and in step S103, it is ascertained if the value of the pointer PN5 is 10*. More specifically, it is determined in step 103 whether the last address of one pattern (0F* of the pattern A) has been read. If the value of the pointer PN5 is not 10*, the program proceeds to step S108, where the pattern data of the address of the output pattern storage region 66, designated by the register B, is read, and based on this logic a solenoid drive control signal is supplied to the output control circuit 60. As a result, the solenoid 10 or the solenoids 32 and 33 are driven such that the doll 9 or 31 moves. The solenoid drive control signal is outputted earlier than read cycle T by an amount equal to the response delay time T0 (as shown by (e) of FIG. 8A).

On the other hand, in step S39, shown in FIG. 7B, all the pointers (excluding the pointers PN4 and PN5) are reset and the program returns to step S6 in FIG. 7A. Then, the operations described above (detection and accumulation of interval data and determination of cycle data) are performed again and the operations shown in FIG. 7A are restarted. At this time, a pattern data read out from the output pattern storage region 66 is advanced by one address since the value of the pointer PN5 was incremented in step S102. Subsequently, the same operations are repeated, and when the read cycle of the last address of one pattern (composed of 16 bytes) occurs, the value of the pointer PN5 becomes 10* and the program proceeds to step S104 by determination in step S103. In step S104, the value of the pointer PN5 is reset. Then, in step S105, the value of the pointer PN4 is incremented by 1. Thus, the read address of the selected pattern storage region 61 is advanced by one. Subsequently, in the step S106, it is ascertained if the value of the pointer PN4 is 6. More specifically, in step S106, it is ascertained if the reading of the last data (the first address) set in the selected pattern storage region 61 is completed. If the value of the pointer PN4 is not 6, the program proceeds to step S108 to read pattern data and to control its output in the same manner as described above. On the other hand, if the value of the pointer PN4 is 6, the pointer PN4 is reset in step S107 and the program proceeds to step S108.

By the above described operations shown in FIG. 7C, 16-byte data of each pattern is provided from the microprocessor 53 to the output control circuit 60 in the movement patterns' preset order. The output control circuit 60 provides control signals S0 to S4 for the solenoids and the electromagnets. Those control signals S0 to S4 correspond to the bits D0 to D4 in the output pattern storage region 66 of the ROM 58. The signal S0 is a control signal for the electromagnet EM1 or the solenoid 32; the signal S2 is a control signal for the electromagnet EM2 or the solenoid 33; and the signals S3 and S4 are control signals for the electromagnet EM3.

Figure 8B:
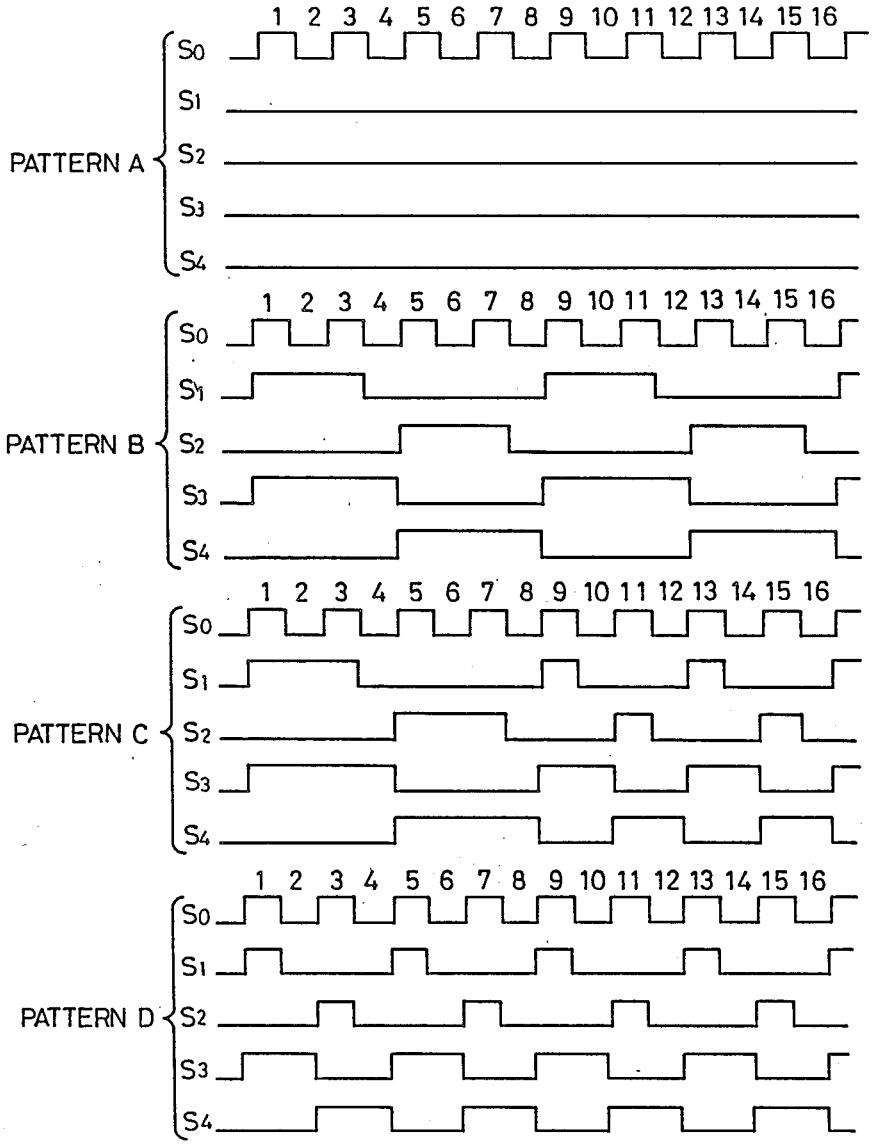

FIG. 8B is an illustration showing an example of output patterns of the control signals provided from the output control circuit 60. In the example of the mechanical portion shown in FIGS. 2A to 2C, the solenoid 10 is energized at the high level of the signal S0 and deenergized at the low level. The electromagnets EM1 and EM2 are energized at the high levels of the signals S1 and S2, respectively, and deenergized at the low levels. Accordingly, for pattern A, the solenoid 10 is energized and deenergized repeatedly for each rhythm cycle so that the doll 9 moves vertically along a straight line in synchronization with the rhythm. On the other hand, in patterns B to D, the electromagnets EM1 and EM2 are also energized and deenergized and, accordingly, the doll 9 not only moves vertically along the straight line, as in pattern A, but also inclines the upper half of its body to the right or to the left. Thus, patterns B to D allow a greater variety of movements than pattern A. The inclining movement of the upper half of the body of the doll 9 is different for each pattern. However, the timing for selecting the inclining movements is always in synchronization with the rhythm of the music.

On the other hand, in the example of the mechanical portion shown in FIGS. 3A to 3C, the solenoids 32 and 33 are energized at the high levels of the signals S1 and S2, and deenergized at the low levels. The electromagnet EM3 is energized at the high level of either the signal S3 or the signal S4 and deenergized at the low levels of both of those signals. Since the direction of the energizing current flowing in the electromagnet EM3 at the high level of the signal S3 and at the high level of signal S4 are opposite to each other, the polarities of both ends of the electromagnet EM3 are reversed at the high levels of signal S3 and signal S4. In this embodiment shown in FIGS. 3A to 3C, pattern A is not adopted. The output pattern is set by combination of patterns B to D. In any of patterns B to D, a movement of the haunches and a movement of the shoulders of the gorilla 31 are combined. A pattern that employs only movement of either the haunches or the shoulders may be adopted.

Thus, this embodiment comprises many movable portions, and many movement patterns can be set for each of the movable portions. As a result, movement of the doll becomes extremely complex, which provides the user with greater amusement.

Then, when the music ends, the rhythm signal extracting circuit 48 no longer provides a rhythm signal and counter CTO overflow is ascertained in steps S12. As a result, the program proceeds to step S40 to clear the cycle data stored in the register W. Subsequently, in step S41, all of the interval data in the interval data storage region 62 is cleared and the program returns to step S6. Then, the program circulates in steps S6, S12, S40 and S41 until music starts again. A step S42, as shown by the dotted lines in FIG. 7A, may be added to clear all of the other data of the RAM 57.

In addition, as described previously, the turntable **8*d* and the motor M (see FIG. 4), used to rotate the doll 9 or 31 may be provided on the base 8*a*. The turntable 8*d* may be rotated by the motor M in synchronization with the rhythm. In this case, empty bits in the output pattern storage region 66 of the RAM 58 may be set as pattern data of the turntable 8*d***.

Although each of the above described embodiments drives the movable portions of the doll in synchronization with musical rhythm, a variable frequency oscillator capable of changing an oscillation cycle may be provided to control the movable portions. The oscillator would perform the function of a metronome.

Next, an example of a single movable portion, as shown in FIG. 1B, will be described. As a mechanical portion of this example, a portion shown in FIGS. 2A to 2C from which the electromagnets EM1 and EM2 are omitted is used. Accordingly, the doll 9 used in this example moves vertically when the solenoid 10 is energized or deenergized.

If this example is applied to the mechanical portion in FIGS. 3A to 3C, the electromagnet EM3 and the permanent magnets MG1 to MG4 are omitted. By energization and deenergization of the solenoids 32 and 33 in combination, the doll 31 of this example moves in any of the following states: the upright state (in FIG. 3A), the state with its haunches moved to the right (in FIG. 3B), and the state with its haunches moved to the left (not shown).

Figure 9:
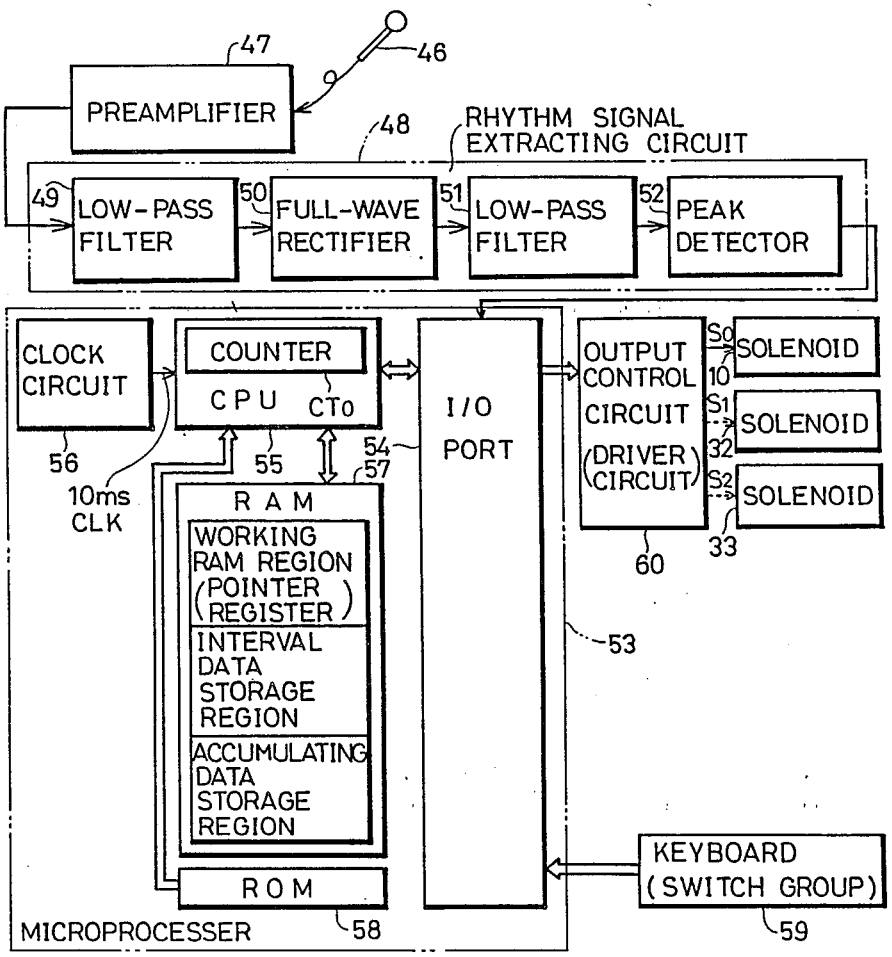
FIG. 9 is block diagram showing a electric circuit portion of another embodiment of the present invention.

FIG. 9 is a diagram showing an electric circuit corresponding to FIG. 1B. The electric circuit shown in FIG. 9 has the same construction as in FIG. 4 except that the electromagnets EM1 and EM3 and the motor M shown in FIG. 4 are not provided. The storage regions of the RAM 57 and the ROM 58 are the same as in FIG. 4. (see FIGS. 5 and 6).

Figure 10:
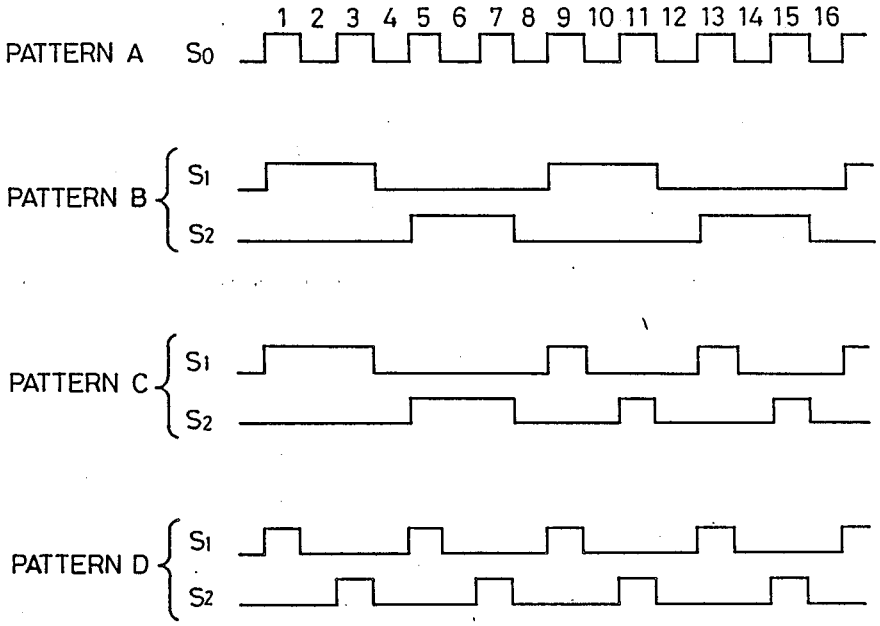
FIG. 10 is a timing chart that explains the operation of the embodiment shown in FIG. 9.

FIG. 10 is a timing chart showing examples of outuut patterns of the output control circuit 60 in FIG. 9. With reference to the patterns in FIG. 10, the operation of a single movable portion will be described. Pattern A is utilized for the example shown in FIGS. 2A and 2B and patterns B to D are particularly utilized for the example shown in FIGS. 3A and 3B. In pattern A, the solenoid 10 is energized at the high level and deenergized at the low level. Accordingly, in pattern A, the solenoid 10 is energized and deenergized for each rhythm cycle so that the doll 9 moves vertically in synchronization with the rhythm. On the other hand, in patterns B to D, signal S1 is a control signal for the solenoid 32 and signal S2 is a control signal for the solenoid 33. The solenoids 32 and 33 are energized at the high levels of the respective signals and deenergized at the low levels. For example, if signal S1 is at the high level, the solenoid 32 is energized and the doll 31 moves its haunches to the right as shown in FIG. 3B. On the other hand, if signal S2 is at the high level, the solenoid 33 is energized and the doll 31 moves its haunches to the left, contrary to FIG. 3B. Thus, the haunch movements, in a 16 beat rhythm, is different for each pattern. Consequently, by selecting amongst those patterns, the doll can be moved in an extremely complicated and interesting manner in synchronization with musical rhythm. Although FIG. 3B shows only one pattern (pattern A) used in the example shown in FIGS. 2A and 2B, other patterns can be applied so that the vertical movement is made not at each cycle, but at every two or three cycles, or in a complicated combination of those cycles. In such cases, several kinds of movement patterns in addition to pattern A may be selected.

Although the above described embodiments are related to a case in which some portions of a toy are moved by a signal detected by a rhythm recognizing apparatus R, the recognizing apparatus R of the present invention is applicable to other apparatuses such as an electronic instrument or an automatic rhythm producing apparatus.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A rhythm recognizing apparatus comprising:

electrical signal generating means for generating an electrical signal in response to music from a source of music, rhythm extracting means comprising filter means for filtering a rhythm signal from said electrical signal, said rhythm signal having a frequency band corresponding to the frequency of the sound of a rhythm producing instrument, and a signal peak detecting means for detecting signal peaks in said rhythm signal and for extracting said signal peaks from said rhythm signal, interval data calculating means for calculating interval data based on intervals between said signal peaks, storage means including a plurality of storage areas for temporarily storing a plurality of said interval data according to frequency of occurrence of similar time values of said interval data, and cycle detecting means for obtaining interval data having the most frequently occurring time values, detecting said interval data having said most frequently occurring time values as a rhythm cycle, and providing a rhythm synchronizing signal in synchronization with said rhythm cycle.

2. A rhythm recognizing apparatus comprising:

electrical signal generating means for generating an electrical signal in response to music from a source of music, rhythm extracting means comprising filter means for filtering a rhythm signal from said electrical signal, said rhythm signal having a frequency band corresponding to the frequency of the sound of a rhythm producing instrument, and a signal peak detecting means for detecting signal peaks in said rhythm signal and for extracting said signal peaks from said rhythm signal, interval data calculating means for calculating interval data based on intervals between said signal peaks, storage means for storing said interval data, and cycle detecting means for detecting a rhythm cycle based on a time interval in said interval data stored in said storage means, said cycle detecting means providing a rhythm synchronizing signal in synchronization with said rhythm cycle, said cycle detecting means comprising determining means for identifying said interval data based on a plurality of time regions having predetermined time lengths, accumulating storage means for accumulating and storing said identification of said interval data, said accumulation and storage based on said plurality of time regions having predetermined time lengths, and cycle detecting means for detecting a time region of said plurality of time regions in which said interval data are identified most frequently.

3. A toy responsive to rhythm comprising:

electrical signal generating means for generating an electrical signal in response to music from a music source, rhythm extracting means comprising filter means for filtering a rhythm signal from said electrical signal, said rhythm signal having a frequency band corresponding to the sound of a rhythm producing instrument, and a signal peak detecting means for detecting signal peaks in said rhythm signal and for extracting said signal peaks from said rhythm signal, interval data collecting means for calculating interval data based on intervals between said signal peaks, storage means for storing said interval data, and cycle detecting means for detecting a rhythm cycle based on a time interval between said interval data stored in said storage means, said cycle detecting means providing a rhythm synchronizing signal in synchronization with said rhythm cycle, a mechanical portion having the shape of a toy and including a base and at least one movable portion in association with said base, drive means for moving said movable portion when said drive means is electrically energized, and output control means responsive to said rhythm synchronizing signal from said cycle detecting means for energizing said drive means.

4. A toy responsive to rhythm in accordance with claim 3, wherein said movable portion comprises a vertical movement mechanism for vertical movement of said toy.

5. A toy responsive to rhythm in accordance with claim 3, wherein said movable portion comprises a horizontal movement mechanism for horizontal movement of said toy, and said mechanical portion comprises a rotating mechanism attached to said horizontal movement mechanism.

6. A toy responsive to rhythm in accordance with claim 5, wherein said horizontal movement mechanism comprises a set of link mechanisms having lower ends supported by said base, any of said link mechanisms being supported on said drive means by a plunger.

7. A toy responsive to rhythm in accordance with claim 5 wherein:

said toy has a body portion having a lower half and an upper half, said horizontal movement mechanism moves said lower half of said body of said toy horizontally, and said rotating mechanism rotates said upper half of said toy.

8. A toy responsive to rhythm in accordance with claim 3, wherein said cycle detecting means comprises timing means for transmitting said rhythm synchronizing signal earlier than the start of said rhythm cycle.

9. A toy responsive to rhythm comprising:

electrical signal generating means for generating an electrical signal in response to music from a music source, rhythm extracting means comprising filter means for filtering a rhythm signal from said electrical signal, said rhythm signal having a frequency band corresponding to the frequency of the sound of a rhythm producing instrument, and a signal peak detecting means for detecting signal peaks in said rhythm signal and for extracting said signal peaks from said rhythm signal, interval data calculating means for calculating interval data based on intervals between said signal peaks, storage means for storing said interval data, cycle detecting means for detecting a rhythm cycle based on a time interval between said interval data stored in said storage means, said cycle detecting means providing a first rhythm synchronizing signal in synchronization with said rhythm cycle, pattern signal generating means for providing a second rhythm synchronizing signal in synchronization with said first rhythm synchronizing signal, a mechanical portion comprising a base, a first movable portion in association with said base and a second movable portion in association with said base, first drive means for moving said first movable portion when said first movable portion is electrically energized, second drive means for moving said second movable portion when said second movable portion is electrically energized, and output control means for energizing said first and second drive means in response to said first rhythm synchronizing signal and said second rhythm synchronizing signal.

10. A toy responsive to rhythm in accordance with claim 9, wherein said first movable portion is structured to move vertically on said base and said second movable portion is structured to move horizontally on said base.

11. A toy responsive to rhythm in accordance with claim 12, wherein said first movable portion is structured to move to the right and left and said second movable portion is rotatable.

12. A toy responsive to rhythm in accordance with claim 9, wherein said base has a rotatable portion that supports said first and second movable portions, and wherein said toy further comprises third drive means for rotating said rotatable portion of said base in response to said first rhythm synchronizing.

13. A toy responsive to rhythm in accordance with claim 9, wherein said pattern signal generating means further comprises means for providing said second rhythm synchronizing signal based on a predetermined pattern, said second rhythm synchronizing signal in sychronization with said first rhythm synchronizing signal and with said rhythm cycle.

14. A toy responsive to rhythm in accordance with claim 9, wherein said first rhythm synchronization signal is provided a prescribed number of times by said cycle detecting means, and said pattern generating means further comprises means for providing said second rhythm synchronizing signal after occurrence of said prescribed number of said first rhythm synchronizing signal, said second rhythm synchronizing signal based on a predetermined pattern and in synchronization with said first rhythm synchronizing signal.

15. A toy responsive to rhythm in accordance with claim 9, wherein said music from said music source has a rhythm component with at least a first and at second occurrence, said rhythm cycle detected by said cycle detecting means has at least a first and a second occurrence, and said cycle detecting means further comprises timing means for providing said first rhythm synchronizing signal, said first rhythm synchronizing signal based on said first occurrence of said rhythm cycle and time to cause movement of said first movable portion in synchronization with said second occurrence of said rhythm component of said music.

16. The rhythm recognizing apparatus of claim 9 wherein said output control means energizes said first drive means in response to said first rhythm synchronizing signal and subsequently energizes said second drive means in response to said second rhythm synchronizing signal.

17. The rhythm recognizing apparatus of claim 12 wherein said output control means energizes said first drive means in response to said second rhythm synchronizing signal and subsequently energizes said second drive means in response to said first rhythm synchronizing signal.

18. A toy responsive to rhythm in accordance with claim 9 wherein said first movable portion is structured to move horizontally on said base and said second movable portion is structured to move vertically on said base.

19. A toy responsive to rhythm in accordance with claim 9, wherein said first movable portion is rotatable and said second movable portion is structured to move to the right and left.

20. A toy responsive to rhythm in accordance with claim 9, wherein said base has a rotatable portion that supports said first and second movable portions, and wherein said toy further comprises a third drive means for rotating said rotatable portion of said base in response to said second rhythm synchronizing signal.

21. A toy responsive to rhythm in accordance with claim 9, wherein said music from said music source has a rhythm component with at least a first and a second occurrence, said rhythm cycle detected by said cycle detecting means has at least a first and a second occurrence, and said cycle detecting means further comprises timing means for providing said first rhythm synchronizing signal, said first rhythm synchronizing signal based on said first occurrence of said rhythm cycle and timed to cause movement of said second movable portion in synchronization with said second occurrence of said rhythm component of said music.

* * * * *